US009295865B2

(12) United States Patent
Willey et al.

(10) Patent No.: US 9,295,865 B2
(45) Date of Patent: Mar. 29, 2016

(54) SURFACTANT COMPOSITION AND METHOD FOR DECONTAMINATION

(71) Applicant: The Procter & Gamble Company, Cincinnati, OH (US)

(72) Inventors: Alan David Willey, Cincinnati, OH (US); Valerie Jean Bradford, Framingham, MA (US); Claire Rebecca Yates, Cincinnati, OH (US); Jacob Robert Adams, Cincinnati, OH (US); Ronak V Rughani, West Chester, OH (US)

(73) Assignee: TOA Research, Inc., Wheat Ridge, CO (US)

( * ) Notice: Subject to any disclaimer, the term of this patent is extended or adjusted under 35 U.S.C. 154(b) by 75 days.

(21) Appl. No.: 13/911,286

(22) Filed: Jun. 6, 2013

(65) Prior Publication Data

US 2013/0338420 A1 Dec. 19, 2013

Related U.S. Application Data

(60) Provisional application No. 61/661,435, filed on Jun. 19, 2012.

(51) Int. Cl.

| | |
|---|---|
| ***C11D 1/72*** | (2006.01) |
| ***C11D 1/722*** | (2006.01) |
| ***C11D 1/75*** | (2006.01) |
| ***C11D 3/08*** | (2006.01) |

(Continued)

(52) U.S. Cl.

CPC .. *A62D 3/36* (2013.01); *A62D 3/30* (2013.01); *C11D 1/825* (2013.01); *C11D 1/8255* (2013.01); *C11D 3/08* (2013.01); *C11D 3/2017* (2013.01); *C11D 3/30* (2013.01); *A62D 2101/02* (2013.01); *C11D 1/667* (2013.01); *C11D 1/72* (2013.01); *C11D 1/74* (2013.01); *C11D 1/75* (2013.01)

(58) Field of Classification Search

CPC ..... C11D 1/72; C11D 1/75; C11D 3/08; C11D 3/2017; C11D 3/30

USPC ..... 510/237, 238, 350, 356, 422, 433, 503, 510/505, 506

See application file for complete search history.

(56) References Cited

U.S. PATENT DOCUMENTS 3,915,902 A * 10/1975 Ancel et al. ..... 510/428
3,916,003 A * 10/1975 Suzuki et al. ..... 554/64

(Continued)

FOREIGN PATENT DOCUMENTS

FR 2766724 A1 2/1999

OTHER PUBLICATIONS

International Search Report dated Feb. 14, 2014, 12 pages.

(Continued)

*Primary Examiner* — Gregory R Delcotto
(74) *Attorney, Agent, or Firm* — Brian J. Elliott

(57) ABSTRACT

Non-corroding cleaning compositions for cleaning exterior surfaces of a vehicle are disclosed. The cleaning compositions include an alkyl dimethylamine oxide surfactant with a first chemical structure, an alkyl dimethylamine oxide surfactant with a second chemical structure, a $C_{8-18}$ alkyl polyethylene glycol sorbitan fatty ester surfactant, a $C_{12-14}$ secondary alcohol ethoxylate surfactant, a sodium nitrite corrosion inhibitor, and sodium metasilicate are disclosed.

15 Claims, 1 Drawing Sheet

(51) Int. Cl.

| | |
|---|---|
| ***A62D 3/36*** | (2007.01) |
| ***C11D 1/825*** | (2006.01) |
| ***C11D 3/30*** | (2006.01) |
| ***C11D 3/20*** | (2006.01) |
| ***A62D 3/30*** | (2007.01) |
| *C11D 1/66* | (2006.01) |
| *C11D 1/74* | (2006.01) |
| *A62D 101/02* | (2007.01) |

(56) References Cited

U.S. PATENT DOCUMENTS

| | | | | |
|---|---|---|---|---|
| 3,983,078 | A | 9/1976 | Collins | |
| 4,154,706 | A * | 5/1979 | Kenkare et al. | 510/123 |
| 4,606,842 | A * | 8/1986 | Keyes et al. | 510/182 |
| 5,372,743 | A * | 12/1994 | Miyamoto et al. | 510/245 |
| 5,468,412 | A * | 11/1995 | Rodzewich | 510/258 |
| 5,516,459 | A * | 5/1996 | Van Eenam | 510/365 |
| 5,880,078 | A | 3/1999 | Bevilacqua, Jr. et al. | |
| 5,922,672 | A * | 7/1999 | Stringer et al. | 510/503 |
| 5,929,009 | A * | 7/1999 | Gambogi | 510/237 |
| 5,939,378 | A * | 8/1999 | Stringer et al. | 510/503 |
| 6,156,712 | A * | 12/2000 | Stringer et al. | 510/125 |
| 6,551,984 | B1 * | 4/2003 | Arvanitidou et al. | 510/463 |
| 6,667,287 | B2 * | 12/2003 | Aszman et al. | 510/191 |
| 7,271,136 | B2 | 9/2007 | Britton | |
| 7,582,598 | B2 | 9/2009 | Hecht et al. | |
| 7,666,264 | B2 | 2/2010 | Britton | |
| 2002/0049149 | A1 * | 4/2002 | Durbut et al. | 510/413 |
| 2003/0083223 | A1 | 5/2003 | Aubay et al. | |
| 2004/0138090 | A1 * | 7/2004 | Drapier et al. | 510/506 |
| 2005/0101511 | A1 * | 5/2005 | Zocchi | 510/475 |
| 2005/0170990 | A1 * | 8/2005 | Hecht et al. | 510/417 |
| 2007/0111924 | A1 | 5/2007 | Ford | |
| 2007/0129275 | A1 | 6/2007 | Hasinovic et al. | |
| 2009/0137440 | A1 * | 5/2009 | Tuzi et al. | 510/218 |
| 2009/0324964 | A1 * | 12/2009 | Jaynes et al. | 428/426 |
| 2010/0010284 | A1 | 1/2010 | Proudlock et al. | |
| 2010/0056416 | A1 * | 3/2010 | Scheuing et al. | 510/284 |
| 2010/0206328 | A1 * | 8/2010 | Dreilinger et al. | 134/6 |
| 2010/0255121 | A1 * | 10/2010 | Perry | 424/665 |
| 2010/0256035 | A1 * | 10/2010 | Konishi et al. | 510/218 |
| 2012/0015862 | A1 * | 1/2012 | Travis et al. | 510/365 |
| 2012/0062256 | A1 | 3/2012 | Kozuka | |

OTHER PUBLICATIONS

MIL-PRF-87937D "Performance Specification, Cleaning Compound, Aerospace Equipment" Department of Defense, Sep. 24, 2001.

* cited by examiner

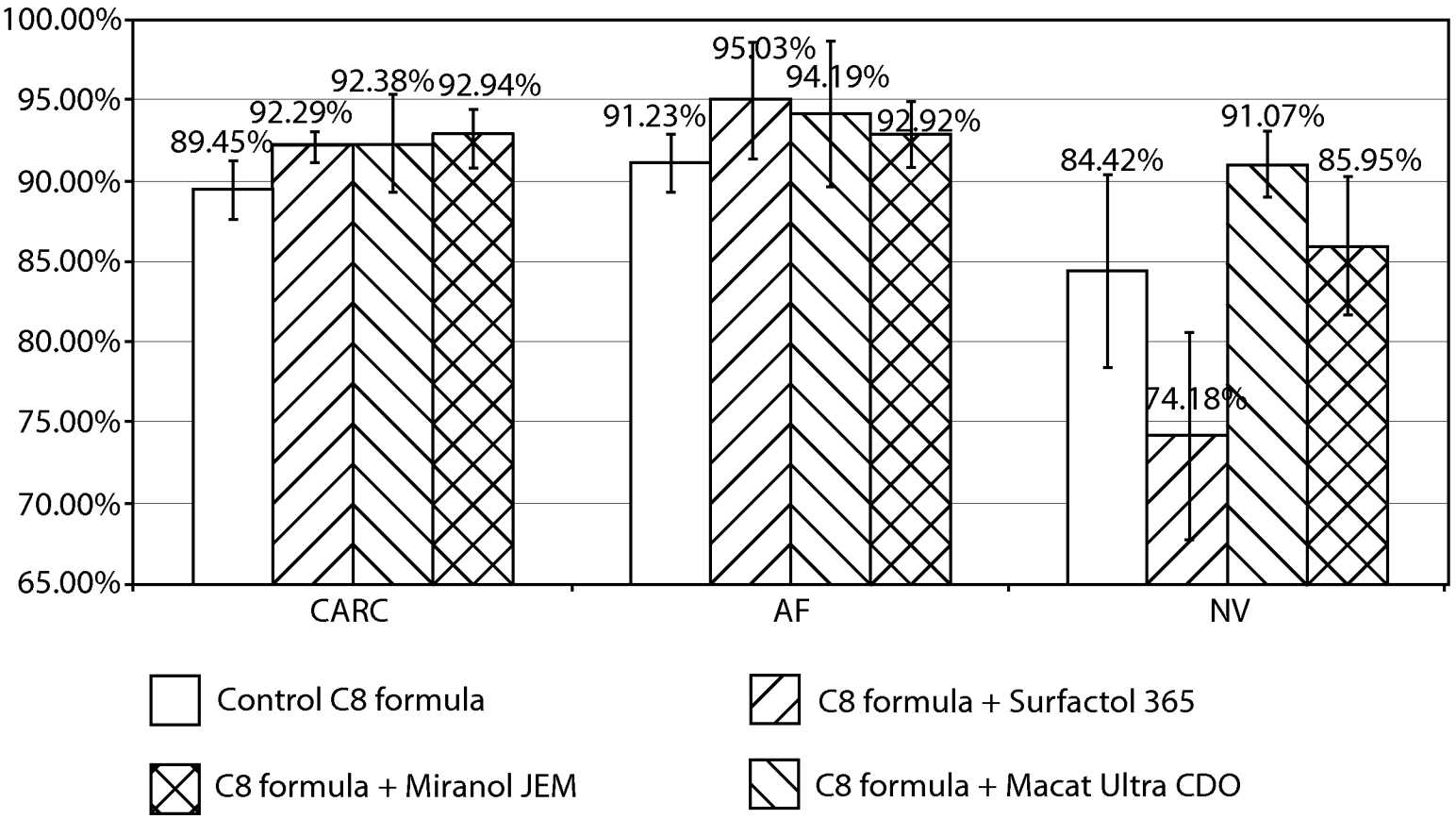
100.00%
95.00%
90.00%
85.00%
80.00%
75.00%
70.00%
65.00%
89.45%
92.29%
92.38%
92.94%
91.23%
95.03%
94.19%
92.92%
84.42%
74.18%
91.07%
85.95%
CARC
AF
NV
Control C8 formula
C8 formula + Miranol JEM
C8 formula + Surfactol 365
C8 formula + Macat Ultra CDO

SURFACTANT COMPOSITION AND METHOD FOR DECONTAMINATION

FIELD OF THE INVENTION

The present invention relates to cleaning compositions and methods for cleaning and, more specifically, to cleaning compositions for cleaning exterior surfaces of a vehicle and methods for cleaning exterior surfaces of a vehicle.

BACKGROUND OF THE INVENTION

Many chemical warfare agents have been developed and stockpiled. Examples of several lethal chemical warfare agents include blister agents such as sulfur mustard and nerve agents. Sulfur mustard is commonly known as mustard gas and includes nitrogen sulfur compounds and chlorinated sulfur compounds. Distilled mustard (i.e. "HD") is the most common formulation of mustard gas. Nerve agents are a class of organophosphates which disrupt the transfer of nerve messages to organs. Nerve agents are divided into two classes: G-series nerve agents and V-series nerve agents. Examples of some nerve agents respectively in the G-series and the V-series include soman (i.e. "GD") and VX.

Current decontamination procedures for removal of such chemical warfare agents from the exterior surfaces of vehicles, such as aircraft, typically employ the following three-step process: 1) pre-washing the exterior surfaces with soapy water to remove dirt; 2) applying a decontaminant composition to the exterior surfaces to remove chemical warfare agents; and 3) rinsing the exterior surfaces. While soapy water provides a basic means to physically remove chemical warfare agents from such exterior surfaces via a two-step process (e.g. involving washing the exterior surfaces with soapy water to remove dirt and chemical warfare agents and rinsing the exterior surfaces), such dual-use soaps have not been developed or effectively fielded.

Accordingly, ongoing needs exist for alternative cleaning compositions and methods for decontamination.

SUMMARY OF THE INVENTION

According to one embodiment, a cleaning composition is provided. The cleaning composition includes a $C_{8-22}$ alkyl dimethylamine oxide surfactant, a $C_{6-12}$ alkyl dimethylamine oxide surfactant, a $C_{8-18}$ alkyl polyethylene glycol sorbitan fatty ester surfactant, and a $C_{12-14}$ secondary alcohol ethoxylate surfactant. The $C_{8-18}$ alkyl polyethylene glycol sorbitan fatty ester surfactant includes from 0 to about 20 ethoxylate groups per $C_{8-18}$ alkyl polyethylene glycol sorbitan fatty ester surfactant molecule. The $C_{12-14}$ secondary alcohol ethoxylate surfactant includes from about 14 to about 16 ethoxylate groups per $C_{12-14}$ secondary alcohol ethoxylate surfactant molecule.

In another embodiment, a method for cleaning exterior surfaces of a vehicle is provided. The method includes providing a cleaning composition, applying the cleaning composition to the exterior surfaces of the vehicle, and rinsing the exterior surfaces of the vehicle with water. The cleaning composition may include a $C_{8-22}$ alkyl dimethylamine oxide surfactant, a $C_{6-12}$ alkyl dimethylamine oxide surfactant, a $C_{8-18}$ alkyl polyethylene glycol sorbitan fatty ester surfactant, and a $C_{12-14}$ secondary alcohol ethoxylate surfactant. The $C_{8-18}$ alkyl polyethylene glycol sorbitan fatty ester surfactant includes from 0 to about 20 ethoxylate groups per $C_{8-18}$ alkyl polyethylene glycol sorbitan fatty ester surfactant molecule. The $C_{12-14}$ secondary alcohol ethoxylate surfactant includes from about 14 to about 16 ethoxylate groups per $C_{12-14}$ secondary alcohol ethoxylate surfactant molecule.

In yet another embodiment, a cleaning composition for cleaning exterior surfaces of a vehicle is provided. The cleaning composition includes from about 0.1% to about 5% by weight of a $C_{8-16}$ alkyl dimethylamine oxide surfactant, from about 0.1% to about 5% by weight of a $C_{6-10}$ alkyl dimethylamine oxide surfactant, from about 0.1% to about 5% by weight of a $C_{10-14}$ alkyl polyethylene glycol sorbitan fatty ester surfactant, and from about 0.1% to about 5% by weight of a $C_{12-14}$ secondary alcohol ethoxylate surfactant including from about 14 to about 16 ethoxylate groups per $C_{12-14}$ secondary alcohol ethoxylate surfactant molecule. The $C_{10-14}$ alkyl polyethylene glycol sorbitan fatty ester surfactant includes from 0 to about 6 ethoxylate groups per $C_{8-18}$ alkyl polyethylene glycol sorbitan fatty ester surfactant molecule. The $C_{12-14}$ secondary alcohol ethoxylate surfactant includes from about 14 to about 16 ethoxylate groups per $C_{12-14}$ secondary alcohol ethoxylate surfactant molecule. The $C_{8-16}$ alkyl dimethylamine oxide surfactant, the $C_{6-10}$ alkyl dimethylamine oxide surfactant, the $C_{10-14}$ alkyl polyethylene glycol sorbitan fatty ester surfactant, and the $C_{12-14}$ secondary alcohol ethoxylate surfactant are provided in a 1:1:1:1 ratio in the cleaning composition. The cleaning composition is effective to remove chemical warfare agents from the exterior surfaces of the vehicle upon application thereto.

Additional features and advantages of the embodiments described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

BRIEF DESCRIPTION OF THE FIGURE

The FIGURE is a graph of percent removal of 2-chloroethylphenyl sulfide by a Control C8 Formula, a C8 Formula+Surfactol® 365, a C8 Formula+Macat® Ultra CDO, and a C8 Formula+Miranol® JEM on chemical agent resistant coated surfaces (i.e. CARC), Air Force topcoat coated surfaces (i.e. AF), and Navy topcoat coated surfaces (i.e. NV).

DETAILED DESCRIPTION OF THE INVENTION

The following terms are used in the present application:

As used herein, the terms "cleaning" and "clean" describe the ability of a composition to remove dirt and/or to neutralize and/or remove dangerous substances. For example, the cleaning compositions described herein have the ability to remove dirt and to remove dangerous substances such as chemical warfare agents and biological warfare agents. Examples of chemical warfare agents include mustard gas and nerve agents.

As used herein, the term "alkyl" describes a saturated monovalent hydrocarbon radical which can be linear (i.e., "straight-chain") such as methyl, ethyl, propyl, and butyl, pentyl, hexyl, heptyl, octyl, nonyl, decyl, undecyl, dodecyl, tridecyl, and C14, C15, C16, C17, C18, C19, C20, C21, C22, C23, and C24 linear alkyl. For alkyl groups containing three or more carbon atoms, the term alkyl describes a saturated monovalent hydrocarbon radical which can be branched. Examples of such groups include, but should not be limited to, isopropyl, isobutyl, and tert-butyl. It is understood by one of ordinary skill in the art that the alkyl groups may be optionally substituted with, for example, one or more of amino, fluorine, chlorine, bromine, chlorine, bromine, iodine, nitro, phenyl, hydroxy, sulfide, thiol, ester, and amide.

As used herein, the term "hydroxyalkyl" describes an alkyl group with a hydroxyl (i.e. —OH) appended thereto.

As used herein, the term "alkyl phenyl group" describes an alky group with a phenyl (i.e.

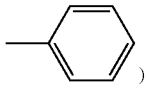

appended thereto.

I. Cleaning Compositions

Reference will now be made in detail to embodiments of a cleaning composition. The cleaning composition includes a $C_{8-22}$ alkyl dimethylamine oxide surfactant, a $C_{6-12}$ alkyl dimethylamine oxide surfactant, a $C_{8-18}$ alkyl polyethylene glycol sorbitan fatty ester surfactant, and a $C_{12-14}$ secondary alcohol ethoxylate surfactant. The $C_{8-18}$ alkyl polyethylene glycol sorbitan fatty ester surfactant containing from 0 to about 20 ethoxylate groups per $C_{8-18}$ alkyl polyethylene glycol sorbitan fatty ester surfactant molecule. The $C_{12-14}$ secondary alcohol ethoxylate surfactant includes from about 14 to about 16 ethoxylate groups per $C_{12-14}$ secondary alcohol ethoxylate surfactant molecule. In one embodiment, the cleaning compositions described herein are aqueous solutions.

The cleaning composition includes an amine oxide surfactant. More particularly, the cleaning composition includes a water-soluble amine oxide surfactant containing a $C_{8-22}$ alkyl group, an amine oxide group, and two methyl groups. Such surfactant is referred to as the $C_{8-22}$ alkyl dimethylamine oxide surfactant. In one embodiment, the $C_{8-22}$ alkyl dimethylamine oxide surfactant includes an amido spacer group which separates the $C_{8-22}$ alkyl group and the amine oxide group. In this particular embodiment, the amido spacer group is separated from the amine oxide group with a $C_{1-3}$ alkyl spacer group. Such $C_{8-22}$ alkyl dimethylamine oxide surfactant may have the following formula:

Formula (I)

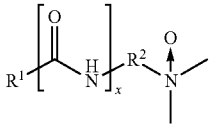

wherein:

$R^1$ is selected from group consisting of a $C_{5-21}$ alkyl, a $C_{5-21}$ hydroxyalkyl, a $C_{5-21}$ alkyl phenyl group, and mixtures thereof;

$R^2$ is a $C_{1-3}$ alkyl; and x is 0 or 1.

In a further embodiment, the $C_{8-22}$ alkyl dimethylamine oxide surfactant is a $C_{8-16}$ alkyl dimethylamine oxide surfactant. In this particular embodiment, $R^1$ may be a $C_{5-13}$ alkyl, $R^2$ may be a $C_3$ alkyl, and x may be 1. In another embodiment, the $C_{8-22}$ alkyl dimethylamine oxide surfactant is a $C_{14}$ alkyl dimethylamine oxide surfactant. In this embodiment, $R^1$ may be a $C_{11}$ linear alkyl, $R^2$ may be a $C_3$ linear alkyl, and x may be 1. In still another embodiment, the $C_{8-22}$ alkyl dimethylamine oxide surfactant is cocoamidopropyl diimethylamine oxide. The $C_{8-22}$ alkyl dimethylamine oxide surfactant is present in the cleaning composition from about 0.1% to about 5%, or from about 0.5% to about 3%, or from about 1% to about 2% by weight of the cleaning composition with a balance of water.

The cleaning composition also includes a short chain amine oxide cosurfactant. Such surfactant is nonionic and may be employed as a cosurfactant in the cleaning composition. More particularly, the cleaning composition includes a nonionic short chain amine oxide surfactant containing a $C_{6-12}$ alkyl group, an amine oxide group, and two methyl groups. Such surfactant or cosurfactant is referred to as the $C_{6-12}$ alkyl dimethylamine oxide surfactant and may have the following formula:

Formula (II)

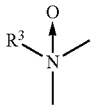

wherein $R^3$ is a $C_{6-12}$ alkyl, $C_{6-12}$ hydroxyalkyl, $C_{6-12}$ alkyl phenyl group, and mixtures thereof.

In a further embodiment, the $C_{6-12}$ alkyl dimethylamine oxide surfactant is a $C_{6-10}$ alkyl dimethylamine oxide surfactant. In this particular embodiment, $R^3$ may be a $C_{6-10}$ linear alkyl. In another embodiment, the $C_{6-12}$ alkyl dimethylamine oxide surfactant is a $C_8$ linear alkyl, wherein $R^3$ is a $C_8$ linear alkyl. In still another embodiment, the $C_{6-12}$ alkyl dimethylamine oxide surfactant is octyldimethylamine oxide. The $C_{6-12}$ alkyl dimethylamine oxide surfactant is present in the cleaning composition from about 0.1% to about 5%, or from about 0.5% to about 3%, or from about 1% to about 2% by weight of the cleaning composition with a balance of water.

The cleaning composition additionally includes a sorbitan ester surfactant. Such surfactant is nonionic. More particularly, the cleaning composition contains a sorbitan ester surfactant having a $C_{8-18}$ alkyl group, a sorbitan group, polyethylene glycol groups, and from 0 to about 20 ethoxylate groups per molecule of sorbitan ester surfactant. Such surfactant is referred to as a $C_{8-18}$ alkyl polyethylene glycol sorbitan fatty ester surfactant. Examples of suitable $C_{8-18}$ alkyl polyethylene glycol sorbitan fatty ester surfactants include, but should not be limited to, polyoxyethylene (20) sorbitan monolaurate, polyoxyethylene (20) sorbitan monopalmitate, polyoxyethylene (20) sorbitan monostearate, polyoxyethylene (20) sorbitan monooleate, polyoxyethylene (4) sorbitan monolaurate, polyoxyethylene (4) sorbitan monostearate, and polyoxyethylene (5) sorbitan monoleate.

In one particular embodiment, the $C_{8-18}$ alkyl polyethylene glycol sorbitan fatty ester surfactant is a $C_{10-14}$ alkyl polyethylene glycol sorbitan fatty ester surfactant. In this particular embodiment, the $C_{10-14}$ alkyl polyethylene glycol sorbitan fatty ester surfactant contains from 0 to about 6 ethoxylate groups per $C_{10-14}$ alkyl polyethylene glycol sorbitan fatty ester surfactant molecule. In a further embodiment, the $C_{8-18}$ alkyl polyethylene glycol sorbitan fatty ester surfactant is a $C_{11}$ alkyl polyethylene glycol sorbitan fatty ester surfactant. In yet another embodiment, the $C_{8-18}$ alkyl polyethylene glycol sorbitan fatty ester surfactant is polyoxyethylene (4) sorbitan monolaurate. The $C_{8-18}$ alkyl polyethylene glycol sorbitan fatty ester surfactant is present in the cleaning composition from about 0.1% to about 5%, or from about 0.5% to about 3%, or from about 1% to about 2% by weight of the cleaning composition with a balance of water.

The cleaning composition also includes a secondary alcohol ethoxylate surfactant. More particularly, the cleaning composition includes a secondary alcohol ethoxylate surfactant containing from about 12 to about 14 carbon atoms and from 0 to about 20 ethoxylate groups per molecule of secondary alcohol ethoxylate surfactant. Such surfactant is referred to as a $C_{12-14}$ secondary alcohol ethoxylate surfactant. In one particular embodiment, the $C_{12-14}$ secondary alcohol ethoxylate surfactant is linear. In another embodiment, the $C_{12-14}$ secondary alcohol ethoxylate surfactant is branched. In one particular embodiment, the $C_{12-14}$ secondary alcohol ethoxylate surfactant is a linear, $C_{12}$ secondary alcohol alkoxylate. More particularly, the linear, $C_{12}$ secondary alcohol alkoxylate is marketed under the tradename Tergitol™ 13-S-5, which includes a mixture of secondary alcohols having an average hydrocarbyl chain length of 12 carbon atoms and an average of 5 moles of ethylene oxide per mole equivalent of alcohol. The $C_{12-14}$ secondary alcohol ethoxylate surfactant is present in the cleaning composition from about 0.1% to about 5%, or from about 0.5% to about 3%, or from about 1% to about 2% by weight of the cleaning composition with a balance of water.

In one particular embodiment, the $C_{8-22}$ alkyl dimethylamine oxide surfactant, the $C_{6-12}$ alkyl dimethylamine oxide surfactant, the $C_{8-18}$ alkyl polyethylene glycol sorbitan fatty ester surfactant, and the $C_{12-14}$ secondary alcohol ethoxylate surfactant are present in a 1:1:1:1 ratio in the cleaning composition. In another embodiment, the pH of the cleaning composition is less than about 10. More particularly, the pH of the cleaning composition is from about 3 to about 10, or from about 5 to about 9, or from about 6 to about 8.

In another embodiment, the cleaning composition may also include at least one corrosion inhibitor. In one embodiment, the corrosion inhibitor may be polymeric or inorganic. For example, the corrosion inhibitor or inhibitors may be selected from the group consisting of: zinc borate, sodium dichromate, monacor 4000, benzotriazole, sodium silicate, sodium benzoate, sodium orthosilicate, sodium metasilicate, Sodium Nitrite, 2-mercaptobenzimidazole, 2-mercaptobenzoxaxole, and mixtures thereof. In one particular embodiment, the cleaning composition includes at least one of sodium nitrite and sodium metasilicate. Each of the corrosion inhibitors is present in the cleaning composition from about 0.01% to about 10% or from about 0.5% to about 5% or from about 1% to about 3% by weight of the cleaning composition.

In one particular embodiment, a cleaning composition for cleaning exterior surfaces of a vehicle is provided. The cleaning composition includes from about 0.1% to about 5% by weight of a $C_{8-16}$ alkyl dimethylamine oxide surfactant, from about 0.1% to about 5% by weight of a $C_{6-10}$ alkyl dimethylamine oxide surfactant, from about 0.1% to about 5% by weight of a $C_{10-14}$ alkyl polyethylene glycol sorbitan fatty ester surfactant, and from about 0.1% to about 5% by weight of a $C_{12-14}$ secondary alcohol ethoxylate surfactant including from about 14 to about 16 ethoxylate groups per $C_{12-14}$ secondary alcohol ethoxylate surfactant molecule. The $C_{10-14}$ alkyl polyethylene glycol sorbitan fatty ester surfactant includes from 0 to about 6 ethoxylate groups per $C_{8-18}$ alkyl polyethylene glycol sorbitan fatty ester surfactant molecule. The $C_{12-14}$ secondary alcohol ethoxylate surfactant includes from about 14 to about 16 ethoxylate groups per $C_{12-14}$ secondary alcohol ethoxylate surfactant molecule. The $C_{8-16}$ alkyl dimethylamine oxide surfactant, the $C_{6-10}$ alkyl dimethylamine oxide surfactant, the $C_{10-14}$ alkyl polyethylene glycol sorbitan fatty ester surfactant, and the $C_{12-14}$ secondary alcohol ethoxylate surfactant are provided in a 1:1:1:1 ratio in the cleaning composition. The cleaning composition is effective to remove chemical warfare agents from the exterior surfaces of the vehicle upon application thereto. One example of a cleaning composition as discussed herein is set forth in Table I below.

The cleaning compositions described herein are effective to remove chemical warfare agents from exterior surfaces of a vehicle upon which it is applied. As previously discussed, the cleaning compositions may be applied to the exterior surfaces of a vehicle, wherein the vehicle may include but should not be limited to, land vehicles, ships, and aircraft. Examples of land vehicles include, but should not be limited to, any type of vehicle adapted to traverse over land including automobiles, trucks, vans, carts, buses, motorcycles, bicycles, mopeds, monorails, freight or passenger trains, trolleys, cable cars, and bullet trains. Examples of ships include, but should not be limited to, any nautical or pseudo-nautical vessel or craft adapted to operate on, in, or directly proximate to a body of water. Examples of aircraft include, but should not be limited to, fixed or variable wing jet aircraft, propeller aircraft, helicopters, vertical short takeoff and/or landing aircraft (i.e. "VSTOL aircraft"), and remotely piloted vehicles. In one particular embodiment, the cleaning compositions described herein are effective to remove chemical warfare agents from exterior surfaces of an aircraft upon which it is applied.

More particularly, as set forth in the examples below, the cleaning compositions described herein are effective to remove chemical warfare agents from exterior surfaces of a vehicle to which they are applied. Moreover, the cleaning composition set forth in Table I below was submitted for evaluation relative to the criteria set forth in MIL-PRF-87937D. More specifically, the cleaning composition was submitted for evaluation relative to the criteria set forth in MIL-PRF-87937D as set forth in Table II below. The cleaning composition conformed on all such criteria; however, it is noted that long term storage stability was not evaluated in this testing.

TABLE I

| Component | Manufacturer | Concentration (g/L) |
|---|---|---|
| Linear, $C_{12}$ secondary alcohol alkoxylate (Tergitol ™ 15-S-9) | Dow Chemical Company (Midland, MI) | 75 |
| Polyoxyethylene (4) Sorbitan Monolaurate (Tween ® 21) | Croda (Edison, NJ) | 75 |
| Octyldimethylamine Oxide (Mackamine C8) | Rhodia (Cranbury, NJ) | 183 |
| Cocoamidopropyl Diimethylamine Oxide (Macat ® Ultra CDO) | Mason Chemical Company (Arlington Heights, IL) | 234 |
| Sodium Nitrite | Aldrich 23721-3 or Equivalent >97% ACS Reagent (St. Louis, MO) | 10 |
| Sodium Metasilicate | Aldrich 30781-5 or Equivalent (St. Louis, MO) | 0.02 |
| Water | Deionized | Balance |

TABLE II

| Specification | Result |
|---|---|
| Biodegradability | Conforms |
| Insoluble Matter | Conforms |
| Flash Point | Conforms |
| Emulsion Characteristics | Conforms |
| Wet Adhesion Tape Test | Conforms |
| % Cleaning Efficiency | Conforms |
| Residual Rinsibility | Conforms |
| Heat Stability | Conforms |
| Cold Stability | Conforms |
| Hydrogen Embrittlement | Conforms |
| Total Immersion Corrosion | Conforms |
| Low-Embrittling Cadmium Plate Corrosion | Conforms |
| Effect on Unpainted Metal Surfaces | Conforms |
| Stress Crazing of MIL-PRF-5425 and MIL-PRF-25690 (Type A and C) Acrylic Plastics | Conforms |
| Stress Crazing of Polycarbonate Plastic | Conforms |
| Hot Dip Galvanizing Corrosion | Conforms |
| Effect on Polysulfide Sealants | Conforms |
| Rubber Compatability | Conforms |
| Effect on Polyimide Insulated Wire | Conforms |

II. Methods for Cleaning Exterior Surfaces of Vehicles

Embodiments of the cleaning compositions have been described in detail. Further embodiments directed to methods of cleaning exterior surfaces of vehicles will now be described. A method for cleaning exterior surfaces of a vehicle is provided. The method includes providing a cleaning composition, applying the cleaning composition to the exterior surfaces of the vehicle, and rinsing the exterior surfaces of the vehicle with water. The cleaning composition is as discussed above.

In one embodiment, the cleaning compositions are applied to the exterior surfaces of the vehicle. In one particular embodiment, the cleaning compositions are applied to the exterior surfaces of an aircraft. The cleaning compositions may be applied to the exterior surfaces of the vehicle by spraying the cleaning composition thereon. Such application may be accomplished with a pressure washer, such as a Hydro Engineering Hydroblaster Model 5/3000 (Hydro Engineering, Inc., Salt Lake City, Utah). More particularly, the cleaning composition may be applied to the exterior surfaces of the vehicle with a nozzle pressure of from about 100 psi to about 165 psi, or alternatively of from about 100 psi to about 130 psi. Additionally, the cleaning composition may be applied to the exterior surfaces of the vehicle at a spray rate of from about 4 gpm to about 6.5 gpm, or alternatively from about 5 gpm to about 6 gpm. In a further embodiment, the method may also include scrubbing the cleaning composition onto the exterior surfaces of the vehicle with a brush.

In another embodiment, the cleaning compositions are rinsed from the exterior surfaces of the vehicle with water. The water may be applied to the exterior surfaces of the vehicle as discussed with regard to applying the cleaning compositions. For example, the water may be sprayed onto the exterior surfaces of the vehicle under high pressure.

In a further embodiment, the method may include diluting the cleaning composition prior to applying the cleaning composition to the exterior surfaces of the vehicle. In one particular embodiment, the cleaning compositions should undergo an 80/20 dilution prior to application. For example, 1 part cleaning composition should be diluted in 4 parts water. Such dilution may be accomplished manually or may be accomplished by siphoning the appropriate amount of cleaning composition into a pressure washer prior to application.

The cleaning compositions described herein may also be effective to clean painted and unpainted metal surfaces in addition to vehicle surfaces. For example, the cleaning compositions described herein may be effective to clean painted and unpainted steel surfaces.

EXAMPLES

The embodiments described herein will be further clarified by the following examples.

Example 1

Removal of Chemical Warfare Simulants with Cleaning Compositions

Experimental Protocol.

The ability of various cleaning compositions to clean exterior surfaces of a vehicle by removing chemical warfare agents was studied. More particularly, the ability of various chemical cleaning compositions to clean a variety of exterior surfaces of a military vehicle by removing chemical warfare simulants was studied.

The cleaning compositions employed were as follows: 1) Control C8 Formula; 2) C8 Formula+Surfactol® 365; 3) C8 Formula+Macat® Ultra CDO; and 4) C8 Formula+Miranol® JEM. The cleaning compositions employed are respectfully set forth in Tables III-VI below.

TABLE III

| Control C8 Formula | | | |
|---|---|---|---|
| Component | Manufacturer | Activity (%) | Weight (g) for 500 mL Solution |
| Linear, $C_{12}$ secondary alcohol alkoxylate (Tergitol ™ 15-S-9) | Dow Chemical Company (Midland, MI) | 100 | 5.0 |
| Polyoxyethylene (4) Sorbitan Monolaurate (Tween ® 21) | Croda (Edison, NJ) | 100 | 5.0 |
| Octyldimethylamine Oxide (Mackamine C8) | Rhodia (Cranbury, NJ) | 41 | 12.2 |
| Water | Deionized | — | q.s. 500 mL |

TABLE IV

| C8 Formula + Surfactol ® 365 | | | |
|---|---|---|---|
| Component | Manufacturer | Activity (%) | Weight (g) for 500 mL Solution |
| Linear, $C_{12}$ secondary alcohol alkoxylate (Tergitol ™ 15-S-9) | Dow Chemical Company (Midland, MI) | 100 | 5.0 |
| Polyoxyethylene (4) Sorbitan Monolaurate (Tween ® 21) | Croda (Edison, NJ) | 100 | 5.0 |
| Octyldimethylamine Oxide (Mackamine C8) | Rhodia (Cranbury, NJ) | 41 | 12.2 |
| Castor Oil Polyethylene Ether (Surfactol ® 365) | Vertellus Performance Materials (Greensboro, NC) | 100 | 5 |
| Water | Deionized | — | q.s. 500 mL |

TABLE V

| C8 Formula + Macat ® Ultra CDO | | | |
|---|---|---|---|
| Component | Manufacturer | Activity (%) | Weight (g) for 500 mL Solution |
| Linear, $C_{12}$ secondary alcohol alkoxylate (Tergitol ™ 15-S-9) | Dow Chemical Company (Midland, MI) | 100 | 7.5 |
| Polyoxyethylene (4) Sorbitan Monolaurate (Tween ® 21) | Croda (Edison, NJ) | 100 | 7.5 |
| Octyldimethylamine Oxide (Mackamine C8) | Rhodia (Cranbury, NJ) | 41 | 18.3 |
| Cocoamidopropyl Diimethylamine Oxide (Macat ® Ultra CDO) | Mason Chemical Company (Arlington Heights, IL) | 32 | 23.4 |
| Water | Deionized | — | q.s. 500 mL |

TABLE VI

| C8 Formula + Miranol ® JEM | | | |
|---|---|---|---|
| Component | Manufacturer | Activity (%) | Weight (g) for 500 mL Solution |
| Linear, $C_{12}$ secondary alcohol alkoxylate (Tergitol ™ 15-S-9) | Dow Chemical Company (Midland, MI) | 100 | 5.0 |
| Polyoxyethylene (4) Sorbitan Monolaurate (Tween ® 21) | Croda (Edison, NJ) | 100 | 5.0 |
| Octyldimethylamine Oxide (Mackamine C8) | Rhodia (Cranbury, NJ) | 41 | 12.2 |
| Sodium Mixed C8 Amphocarboxylate (Miranol ® JEM) | Rhodia (Cranbury, NJ) | 28.7 | 17.4 |
| Water | Deionized | — | q.s. 500 mL |

The cleaning compositions set forth in Tables III-VI were prepared by mixing in a 55 gallon drum in accordance with the following procedure: 1) Tergitol™, Tween®, Mackamine C8, and water were added to the drum and were mixed, but not so vigorously as to cause excessive foaming; and 2) With regard to the C8 Formula+Surfactol® 365, the C8 Formula+Macat® Ultra CDO, and the C8 Formula+Miranol® JEM cleaning compositions, Surfactol® 365, Macat® Ultra CDO, or Miranol® JEM were slowly added to the drum with mixing. It is noted that the mixing order was important because Surfactol® 365, Macat® Ultra CDO, and/or Miranol® JEM can cause a gel to form that is difficult and time consuming to mix until it dissolves. Accordingly, it is necessary to add Surfactol® 365, Macat® Ultra CDO, and Miranol® JEM last and to add it slowly to prevent such gel formation.

Test coupons containing chemical agent resistant coated (hereinafter "CARC") surfaces, Air Force topcoat (hereinafter "AF") coated surfaces, and Navy topcoat (hereinafter "NV") coated surfaces were obtained from the Edgewood Chemical Biological Warfare Center (APG, MD). Such test coupons had a 2-inch diameter. Additionally, such test coupons were coated with CARC, AF, and NV to simulate a variety of exterior surfaces of vehicles employed by the United States Military.

Prior to applying chemical warfare simulants to the exterior surfaces of the test coupons, the test coupons were cleaned in accordance with the following procedure: 1) A common dish soap solution was diluted in distilled water; 2) The test coupons were covered with soap solution; 3) The test coupons were scrubbed by hand or with a mechanical scrubbing machine for 5 minutes; 4) The test coupons were rinsed 5 times with ~550 mL distilled water for each rinse; and 5) The test coupons were allowed to air dry and were stored in separate boxes separated with cleaning wipes. In this particular example, the common dish soap employed was Dawn® Dish Soap (Procter & Gamble, Cincinnati, Ohio), containing at least water, sodium lauryl sulfate, sodium pareth-23, sulfate C-12-14-16, dimethyl amine oxide, SD alcohol, undeceth-9, propylene glycol, cyclohexandiamine, polyacetate, protease, fragrance, FD&C blue, no phosphate. Such dish soap was diluted by adding 0.48 g of Dawn® to 475 g of distilled water. Also in this particular example, the cleaning wipes employed were Kimwipes® (Kimberly-Clark, Neenah, Wis.).

The ability of the cleaning compositions set forth in Tables III-VI to remove CEPS from the test coupons coated with CARC, AF, or NV was then evaluated in accordance with the following procedure: 1) The test coupons were contaminated with ten 1 microliter drops of the chemical warfare HD simulant, 2-chloroethylphenyl sulfide (hereinafter "CEPS") spaced evenly around the coated surfaces of the test coupons; 2) The contaminated test coupons were allowed to age for 1 H in a closed glass jar containing a weigh dish; 3) 50 mL of the cleaning compositions set forth in Tables III-VI were placed in separate empty jars; 4) The contaminated test coupons were transferred to the jars containing the compositions set forth in Tables III-VI such that each of the jars contained 1 test coupon; 5) A paddle of a stirrer was placed into the solutions in each jar to a position ~1 cm above the test coupon; 6) Each solution was stirred at room temperature for 10 min at ~150 rpm; 7) The cleaning compositions were poured off of the test coupons; 8) The test coupons were removed from the jars and placed into separate glass jars containing 50 mL of distilled water and were allowed to soak for 10 minutes; 9) The water was poured off of the test coupons; 10) The test coupons were transferred to separate weigh dishes; 11) 5 mL of chloroform was applied to each test coupon in the weigh dishes and allowed to soak for 5 minutes in separate closed glass jars; and 12) A sample of the chloroform was obtained from each glass jar and analyzed for CEPS by gas chromatography. CEPS was chosen for these studies because HD has poor solubility in water and was therefore thought to present the greatest challenge for removal.

The amount of CEPS removed from the test coupons was calculated by comparison of gas chromatographs between the original 10 microliters dissolved in 5 mL chloroform and the sample obtained from the glass jar at the end of the test.

Experimental Results.

As shown in FIG. 1, only the C8 Formula+Macat® Ultra CDO cleaning composition employed in these studies was effective to remove greater than about 90% of the chemical warfare HD simulant, CEPS, on all surfaces tested (i.e. CARC, AF, and NV).

Example 2

Effect of Various Concentrations of C8 Formula+Macat® Ultra CDO Cleaning Compositions with Corrosion Inhibitors on the Removal of CEPS Experimental Protocol.

The ability of various cleaning compositions to clean exterior surfaces of a vehicle by removing chemical warfare agents will be studied. More particularly, the ability of various concentrations of a chemical cleaning composition to clean a variety of exterior surfaces of a vehicle by removing chemical warfare simulants will be studied.

The cleaning compositions to be employed in this study are as previously set forth in Table I and as set forth in Tables VII-IX below. The composition set forth in Table I will serve as a control. The cleaning compositions will be prepared in accordance with the procedure as previously discussed with regard to the cleaning compositions set forth in Table III-VI in Example I, except that the procedure will include the additional step of adding Sodium Nitrite and Sodium Metasilicate with mixing until dissolved. More particularly, the Sodium Nitrite and the Sodium Metasilicate will be added as the last step in the procedure with mixing until dissolved.

TABLE VII

| Component | Manufacturer | Concentration (g/L) |
|---|---|---|
| Linear, $C_{12}$ secondary alcohol alkoxylate (Tergitol ™ 15-S-9) | Dow Chemical Company (Midland, MI) | 150 |
| Polyoxyethylene (4) Sorbitan Monolaurate (Tween ® 21) | Croda (Edison, NJ) | 75 |
| Octyldimethylamine Oxide (Mackamine C8) | Rhodia (Cranbury, NJ) | 183 |
| Cocoamidopropyl Diimethylamine Oxide (Macat ® Ultra CDO) | Mason Chemical Company (Arlington Heights, IL) | 234 |
| Sodium Nitrite | Aldrich 23721-3 or Equivalent >97% ACS Reagent (St. Louis, MO) | 10 |
| Sodium Metasilicate | Aldrich 30781-5 or Equivalent (St. Louis, MO) | 0.02 |
| Water | Deionized | Balance |

TABLE VIII

| Component | Manufacturer | Concentration (g/L) |
|---|---|---|
| Linear, $C_{12}$ secondary alcohol alkoxylate (Tergitol ™ 15-S-9) | Dow Chemical Company (Midland, MI) | 75 |
| Polyoxyethylene (4) Sorbitan Monolaurate (Tween ® 21) | Croda (Edison, NJ) | 75 |
| Octyldimethylamine Oxide (Mackamine C8) | Rhodia (Cranbury, NJ) | 286 |
| Cocoamidopropyl Diimethylamine Oxide (Macat ® Ultra CDO) | Mason Chemical Company (Arlington Heights, IL) | 234 |
| Sodium Nitrite | Aldrich 23721-3 or Equivalent >97% ACS Reagent (St. Louis, MO) | 10 |
| Sodium Metasilicate | Aldrich 30781-5 or Equivalent (St. Louis, MO) | 0.02 |
| Water | Deionized | Balance |

TABLE IX

| Component | Manufacturer | Concentration (g/L) |
|---|---|---|
| Linear, $C_{12}$ secondary alcohol alkoxylate (Tergitol ™ 15-S-9) | Dow Chemical Company (Midland, MI) | 150 |

TABLE IX-continued

| Component | Manufacturer | Concentration (g/L) |
|---|---|---|
| Polyoxyethylene (4) Sorbitan Monolaurate (Tween ® 21) | Croda (Edison, NJ) | 150 |
| Octyldimethylamine Oxide (Mackamine C8) | Rhodia (Cranbury, NJ) | 183 |
| Cocoamidopropyl Diimethylamine Oxide (Macat ® Ultra CDO) | Mason Chemical Company (Arlington Heights, IL) | 234 |
| Sodium Nitrite | Aldrich 23721-3 or Equivalent >97% ACS Reagent (St. Louis, MO) | 10 |
| Sodium Metasilicate | Aldrich 30781-5 or Equivalent (St. Louis, MO) | 0.02 |
| Water | Deionized | Balance |

Test coupons as previously discussed in Example 1 will be obtained. The test coupons will also be cleaned as previously discussed in Example 1. The ability of the cleaning compositions set forth in Tables I and VII-IX to remove CEPS from the test coupons coated with CARC, AF, or NV will then be evaluated in accordance with the procedure as previously discussed in Example 1.

Experimental Results.

The cleaning compositions set forth in Tables VII-IX are expected to be effective to remove greater than about 90% of the chemical warfare HD simulant, CEPS, on CARC and AF coated surfaces and are also expected to be effective to remove greater than about 80% of CEPS on NV coated surfaces.

Example 3

Effect of the $C_{8-18}$ Alkyl Polyethylene Glycol Sorbitan Fatty Ester Surfactant Cleaning Compositions on Removal of CEPS Experimental Protocol.

The ability of cleaning compositions to clean exterior surfaces of a vehicle by removing chemical warfare agents will be studied. More particularly, the ability of cleaning compositions containing polyoxyethylene (20) sorbitan monopalmitate (polysorbate 40) to remove chemical warfare simulants from exterior surfaces of a vehicle will be studied.

The cleaning compositions to be employed in this study are as previously set forth in Table I and as set forth in Table X below. The composition set forth in Table I will serve as a control. The cleaning compositions will be prepared in accordance with the procedure as previously discussed with regard to the cleaning compositions set forth in Table III-VI in Example I, except that: 1) with regard to the cleaning composition set forth in Table X, polyoxyethylene (20) sorbitan monopalmitate (polysorbate 40) will be employed instead of Tween®; and 2) the procedure will include the additional step of adding Sodium Nitrite and Sodium Metasilicate with mixing until dissolved. More particularly, the Sodium Nitrite and the Sodium Metasilicate will be added as the last step in the procedure with mixing until dissolved.

TABLE X

| Component | Manufacturer | Concentration (g/L) |
|---|---|---|
| Linear, $C_{12}$ secondary alcohol alkoxylate (Tergitol ™ 15-S-9) | Dow Chemical Company (Midland, MI) | 75 |
| Polyoxyethylene (20) Sorbitan Monopalmitate (polysorbate 40) | Uniquema (Edison, NJ) | 75 |
| Octyldimethylamine Oxide (Mackamine C8) | Rhodia (Cranbury, NJ) | 183 |
| Cocoamidopropyl Diimethylamine Oxide (Macat ® Ultra CDO) | Mason Chemical Company (Arlington Heights, IL) | 234 |
| Sodium Nitrite | Aldrich 23721-3 or Equivalent >97% ACS Reagent (St. Louis, MO) | 10 |
| Sodium Metasilicate | Aldrich 30781-5 or Equivalent (St. Louis, MO) | 0.02 |
| Water | Deionized | Balance |

Test coupons as previously discussed in Example 1 will be obtained. The test coupons will also be cleaned as previously discussed in Example 1. The ability of the cleaning compositions set forth in Tables I and X to remove CEPS from the test coupons coated with CARC, AF, or Navy will then be evaluated in accordance with the procedure as previously discussed in Example 1.

Experimental Results.

The cleaning composition set forth in Table X is expected to be effective to remove greater than about 90% of the chemical warfare HD simulant, CEPS, on CARC and AF coated surfaces and is also expected to be effective to remove greater than about 80% of CEPS on NV coated surfaces.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

It is noted that terms like "preferably," "generally," "commonly," and "typically" are not utilized herein to limit the scope of the claims or to imply that certain features are critical, essential, or even important to the structure or function of the claims. Rather, these terms are merely intended to highlight alternative or additional features that may or may not be utilized in a particular embodiment of the present disclosure.

Unless otherwise indicated, all numbers expressing quantities of ingredients, properties such as reaction conditions, and so forth used in the specification and claims are to be understood as being modified in all instances by the term "about." Accordingly, unless indicated to the contrary, the numerical parameters set forth in this specification and claims are approximations that can vary depending upon the desired properties sought to be obtained by the presently-disclosed subject matter.

For the purposes of describing and defining the present disclosure it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A non-corroding vehicle cleaning composition comprising:

a) an alkyl dimethylamine oxide surfactant having the chemical structure:

Formula (I)

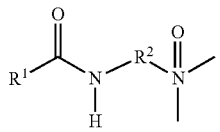

Formula (I)

wherein:

$R^1$ is selected from group consisting of a $C_{5-13}$ alkyl, $R^2$ is a $C_3$ alkyl; and x is 1;

b) an alkyl dimethylamine oxide surfactant having the chemical structure:

Formula (II)

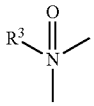

Formula (II)

wherein $R^3$ is a $C_{6-10}$ alkyl;

c) a $C_{8-18}$ alkyl polyethylene glycol sorbitan fatty ester surfactant comprising from 0 to about 20 ethoxylate groups per $C_{8-18}$ alkyl polyethylene glycol sorbitan fatty ester surfactant molecule;

d) a $C_{12-14}$ secondary alcohol ethoxylate surfactant comprising from about 14 to about 20 ethoxylate groups per $C_{12-14}$ secondary alcohol ethoxylate surfactant molecule;

e) a sodium nitrite corrosion inhibitor;

f) sodium metasilicate; and g) a pH from 6.0 to 8.0.

2. The cleaning composition of claim 1, wherein the alkyl dimethylamine oxide surfactant according to Formula (I) is cocoamidopropyl dimethylamine oxide.

3. The cleaning composition of claim 1, wherein the alkyl dimethylamine oxide surfactant according to Formula (II) is octyldimethylamine oxide.

4. The cleaning composition of claim 1, wherein the $C_{8-18}$ alkyl polyethylene glycol sorbitan fatty ester surfactant is a $C_{10-14}$ alkyl polyethylene glycol sorbitan fatty ester surfactant comprising from 0 to about 6 ethoxylate groups per $C_{10-14}$ alkyl polyethylene glycol sorbitan fatty ester surfactant molecule.

5. The cleaning composition of claim 1, wherein the $C_{8-18}$ alkyl polyethylene glycol sorbitan fatty ester surfactant is polyoxyethylene (4) sorbitan monolaurate.

6. The cleaning composition of claim 1, wherein the $C_{12-14}$ secondary alcohol ethoxylate surfactant is a branched secondary alcohol ethoxylate surfactant.

7. The cleaning composition of claim 1, wherein:

the alkyl dimethylamine oxide surfactant according to Formula (I) comprises from about 0.1% to about 5% by weight of the cleaning composition;

the alkyl dimethylamine oxide surfactant according to Formula (II) comprises from about 0.1% to about 5% by weight of the cleaning composition;

the $C_{8-18}$ alkyl polyethylene glycol sorbitan fatty ester surfactant comprises from about 0.1% to about 5% by weight of the cleaning composition; and the $C_{12-14}$ secondary alcohol ethoxylate surfactant comprises from about 0.1% to about 5% by weight of the cleaning composition.

8. The cleaning composition of claim 1, wherein:

the alkyl dimethylamine oxide surfactant according to Formula (I) comprises from about 0.5% to about 3% by weight of the cleaning composition;

the alkyl dimethylamine oxide surfactant according to Formula (II) comprises from about 0.5% to about 3% by weight of the cleaning composition;

the $C_{8-18}$ alkyl polyethylene glycol sorbitan fatty ester surfactant comprises from about 0.5% to about 3% by weight of the cleaning composition; and the $C_{12-14}$ secondary alcohol ethoxylate surfactant comprises from about 0.5% to about 3% by weight of the cleaning composition.

9. The cleaning composition of claim 1, wherein:

the alkyl dimethylamine oxide surfactant according to Formula (I) comprises from about 1% to about 2% by weight of the cleaning composition;

the alkyl dimethylamine oxide surfactant according to Formula (II) comprises from about 1% to about 2% by weight of the cleaning composition;

the $C_{8-18}$ alkyl polyethylene glycol sorbitan fatty ester surfactant comprises from about 1% to about 2% by weight of the cleaning composition; and the $C_{12-14}$ secondary alcohol ethoxylate surfactant comprises from about 1% to about 2% by weight of the cleaning composition.

10. The cleaning composition of claim 1, wherein the alkyl dimethylamine oxide surfactant according to Formula (I), the alkyl dimethylamine oxide surfactant according to Formula (II), the $C_{8-18}$ alkyl polyethylene glycol sorbitan fatty ester surfactant, and the $C_{12-14}$ secondary alcohol ethoxylate surfactant comprise a 1:1:1:1 ratio by weight in the cleaning composition.

11. The cleaning composition of claim 1, wherein the cleaning composition is effective to remove chemical warfare agents from exterior surfaces of a vehicle upon application thereto.

12. A cleaning composition for cleaning exterior surfaces of a vehicle, the cleaning composition comprising:

a) from about 0.1% to about 5% by weight of a alkyl dimethylamine oxide surfactant having the chemical structure:

Formula (I)

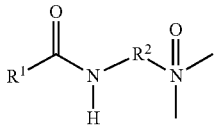

wherein:

$R^1$ is selected from group consisting of a $C_{5-13}$ alkyl, $R^2$ is a $C_3$ alkyl; and x is 1;

b) from about 0.1% to about 5% by weight of a alkyl dimethylamine oxide surfactant having the chemical structure:

Formula (II)

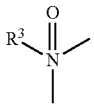

wherein $R^3$ is a $C_{6-10}$ alkyl;

c) from about 0.1% to about 5% by weight of a $C_{10-14}$ alkyl polyethylene glycol sorbitan fatty ester surfactant comprising from 0 to about 6 ethoxylate groups per $C_{8-18}$ alkyl polyethylene glycol sorbitan fatty ester surfactant molecule;

d) from about 0.1% to about 5% by weight of a $C_{12-14}$ secondary alcohol ethoxylate surfactant comprising from about 14 to about 20 ethoxylate groups per $C_{12-14}$ secondary alcohol ethoxylate surfactant molecule;

e) a sodium nitrite corrosion inhibitor;

f) sodium metasilicate; and g) a pH from 6.0 to 8.0;

wherein: the alkyl dimethylamine oxide surfactant according to Formula (I), the alkyl dimethylamine oxide surfactant according to Formula (II), the $C_{10-14}$ alkyl polyethylene glycol sorbitan fatty ester surfactant, and the $C_{12-14}$ secondary alcohol ethoxylate surfactant comprise a 1:1:1:1 ratio by weight in the cleaning composition, and the cleaning composition is effective to remove chemical warfare agents from the exterior surfaces of the vehicle upon application thereto.

13. The composition of claim 1, wherein the cleaning composition further conforms to both the Heat Stability and Total Immersion Corrosion test specifications of MIL-PRF-87937D.

14. The composition of claim 13, wherein the cleaning composition removes over 90% of a chemical warfare agent simulant that has been applied as ten 1-microliter droplets on a vehicle surface.

15. The composition of claim 14, wherein the vehicle surface is a Navy Topcoat coated surface.

* * * * *